US008421788B2

(12) United States Patent
Kubota et al.

(10) Patent No.: US 8,421,788 B2
(45) Date of Patent: Apr. 16, 2013

(54) POWER SUPPLY CIRCUIT AND IMAGE DISPLAY APPARATUS USING THE SAME

(75) Inventors: Hidenao Kubota, Yokohama (JP); Yuzo Nishinaka, Chigasaki (JP); Yuki Iwane, Chigasaki (JP); Yutaka Yamada, Yokohama (JP); Katsunobu Kimura, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 1372 days.

(21) Appl. No.: 11/604,331

(22) Filed: Nov. 27, 2006

(65) Prior Publication Data

US 2007/0165017 A1 Jul. 19, 2007

(30) Foreign Application Priority Data

Jan. 18, 2006 (JP) ..... 2006-009472

(51) Int. Cl.
*G09G 5/00* (2006.01)

(52) U.S. Cl.
USPC ..... 345/211

(58) Field of Classification Search ..... 345/211, 345/87; 714/14
See application file for complete search history.

(56) References Cited

U.S. PATENT DOCUMENTS

| | | | | |
|---|---|---|---|---|
| 4,779,025 | A * | 10/1988 | Paynton et al. | 313/478 |
| 6,668,151 | B2 * | 12/2003 | Uehara et al. | 399/328 |
| 7,408,543 | B2 * | 8/2008 | Kimura et al. | 345/211 |
| 2002/0015293 | A1 * | 2/2002 | Akiba et al. | 361/793 |
| 2002/0194746 | A1 * | 12/2002 | Lancer | 34/90 |
| 2002/0199131 | A1 * | 12/2002 | Kocin | 714/14 |
| 2003/0107450 | A1 * | 6/2003 | Jamal et al. | 333/24 R |
| 2003/0107540 | A1 * | 6/2003 | Kee | 345/87 |
| 2004/0118194 | A1 * | 6/2004 | Raichle | 73/118.1 |
| 2004/0146061 | A1 * | 7/2004 | Bisceglia et al. | 370/419 |
| 2004/0196277 | A1 * | 10/2004 | Kawaguchi et al. | 345/211 |
| 2005/0059998 | A1 * | 3/2005 | Norte et al. | 607/2 |
| 2005/0088141 | A1 * | 4/2005 | Lee et al. | 320/114 |
| 2005/0156568 | A1 * | 7/2005 | Yueh | 320/128 |
| 2006/0033451 | A1 * | 2/2006 | Chang et al. | 315/247 |
| 2006/0145658 | A1 * | 7/2006 | Wang | 320/107 |
| 2006/0224907 | A1 * | 10/2006 | Feldman et al. | 713/300 |
| 2008/0094153 | A1 * | 4/2008 | Wang et al. | 333/177 |

FOREIGN PATENT DOCUMENTS

| | | |
|---|---|---|
| JP | 03-145925 | 6/1991 |
| JP | 2004-029264 | 1/2004 |
| JP | 2005-221604 | 8/2005 |
| KR | 10-2004-0110624 | 12/2004 |

* cited by examiner

*Primary Examiner* — Quan-Zhen Wang
*Assistant Examiner* — Tony Davis
(74) *Attorney, Agent, or Firm* — Antonelli, Terry, Stout & Kraus, LLP.

(57) ABSTRACT

It is an object of the present invention to provide an image display apparatus which enables cost reduction while being free from electromagnetic interference problems.

A power supply circuit comprises, on a single circuit board, an AC inlet to which a power cord is connected from an external AC power supply, a filter circuit to which an inductance element is connected to suppress leakage of electromagnetic waves to the outside of the image display apparatus, and a switch which switches on/off an AC output supplied from the filter circuit. The circuit board of the power supply circuit is entirely covered by electromagnetic shielding means to shield electromagnetic waves. The electromagnetic shielding means is composed of, for example, a first shielding section which surrounds the lateral side of the circuit board and a second shielding section which covers the upper side of the circuit board. The second shielding section is formed of a part of the flat section of a rear cover of the image display apparatus.

8 Claims, 7 Drawing Sheets

POWER SUPPLY CIRCUIT AND IMAGE DISPLAY APPARATUS USING THE SAME

CLAIM OF PRIORITY

The present application claims priority from Japanese application serial No. P2006-009472, filed on Jan. 18, 2006, the content of which is hereby incorporated by reference into this application.

BACKGROUND OF THE INVENTION

The present invention relates to a power supply circuit for an image display apparatus. More particularly, the present invention relates to a technique for preventing leakage of electromagnetic waves generated in the apparatus to the outside of the apparatus.

Conventionally, electronic apparatuses have been requested to comply with the requirements of the EMC (Electromagnetic Compatibility) standards, i.e., the EMI (Electro Magnetic Interference) measures for preventing unintended emission of electromagnetic waves and the EMS (Electro Magnetic Susceptance) measures for preventing malfunction upon reception of electromagnetic waves. In Japan, the VCCI (Voluntary Control Council for Interference by Information Technology Equipment) was established and self-imposed regulations are conducted based on recommendations of the CISPR (International Special Committees on Radio Interference). This also applies to the U.S. and Europe. Image display apparatus, such as a display apparatus with a plasma display panel, are subjected to the regulations since they generate electromagnetic waves from a display unit such as a plasma display panel. The regulations demand that leakage of the electromagnetic waves to the outside of the apparatus be reduced to a predetermined level. A power supply unit of the apparatus is one of paths which electromagnetic waves leak to the outside. Since electromagnetic waves leak to the side of a commercial power supply, etc. through a power cord or the like, measures are taken so that electromagnetic waves are attenuated by a filter circuit in the power supply unit.

FIG. 6 is a schematic diagram showing a circuit configuration of a conventional display apparatus with a plasma display panel. The circuit shown in FIG. 6 comprises: a power supply circuit including a circuit board 13*a*1' with a power cord 30' directly connected thereto and a filter circuit A' formed thereon which includes an inductance element; a circuit board 13*a*2' with a fuse 60' connected thereto and a filter circuit B' formed thereon; and a circuit board 13*a*3' with a switch circuit formed thereon which switch on/off the connection between the fuse 60' and the filter circuit B'. The circuit shown in FIG. 6 further comprises: a circuit board 13*b*' with a power supply unit S' formed thereon which includes a filter circuit C' with inductance elements connected thereto; a circuit board 12*a*' with a drive circuit D1' formed thereon which drives a plasma display panel 11' as a display unit based on an image signal; a circuit board 12*b*' with a drive circuit D2' formed thereon; and a rear cover 16' for covering the rear side of the display apparatus.

FIG. 7 is a diagram showing an example of the configuration of a display apparatus with a plasma display panel using the circuit shown in FIG. 6. In FIG. 7, a retaining fitting 14' for retaining a circuit boards 13*a*1', 13*a*2' and 13*a*', a circuit board 13*b*', and circuit boards 12*a*' and 12*b*' are arranged between the plasma display panel 11' and the rear cover 16'. A front filter 15' is arranged at the front of the plasma display panel 11'. In the above configuration, electromagnetic waves in the power supply circuit and the power supply unit S' shown in FIG. 6 are attenuated by use of filter circuits A', B' and C'.

One of conventional arts relevant to the present invention is described, for example, in Japanese Patent Laid-open No. 2004-29264. This patent gazette describes a configuration in which a noise filter circuit installed at the rear side of a plasma display panel is covered by a cover of magnetic metal material and a portion of the cover close to the noise filter circuit is secured to a chassis member in order to provide a plasma display apparatus which does not generate audible noise sound.

Japanese Patent Laid-open No. 2004-29264

SUMMARY OF THE INVENTION

In order to further popularize display apparatus with a plasma display panel or the like, further remarkable cost reduction is demanding while predetermined performance is ensured. With the conventional configuration shown in FIG. 6 and FIG. 7, electromagnetic waves are prevented from leaking from the power supply unit to the outside of the apparatus. However, since the power supply circuit is composed of three circuit boards, circuit boards 13*a*1, 13*a*2, and 13*a*3, it is necessary to prepare connecting sections for connecting these circuit boards with each other, connect between these connecting sections when assembling the apparatus, and separately manufacture each of the circuit boards, resulting in cost increase. Further, the above-mentioned Japanese Patent Laid-open No. 2004-29264 discloses a noise filter circuit having a noise filter and a cover. However, since the invention disclosed in this patent gazette aims at suppressing audible noise sound generated by the strength of absorption force between the noise filter and the cover based on the strength of leakage flux due to an AC current in conjunction with an AC power frequency, the patent gazette only describes a configuration in which the noise filter circuit is covered by a cover for entirely covering the rear side of the apparatus.

In view of the situation of the above-mentioned conventional art, a subject of the present invention is to prevent electromagnetic waves generated in the display unit from leaking to the outside of an image display apparatus such as a display apparatus with a plasma display panel, thereby resulting in cost reduction of the power supply circuit.

The present invention provides a display apparatus which solves the above-mentioned subject and achieve the cost reduction while being free from electromagnetic interferences.

According to the present invention, an image display apparatus comprises, on a single circuit board, an power supply circuit having an AC inlet to which a power cord is connected from an external AC power supply, a filter circuit to which an inductance element is connected to attenuate electromagnetic waves, and a switch which switches on/off an AC output supplied from the filter circuit. The circuit board of the power supply circuit is entirely covered by electromagnetic shielding means to shield electromagnetic waves. The electromagnetic shielding means is composed of, for example, a first shielding section which surrounds the lateral side of the above-mentioned circuit board and a second shielding section which covers the upper side of the circuit board, wherein the second shielding section is formed of a part of the flat section of the rear cover of the display apparatus.

According to the present invention, it is possible to provide an image display apparatus which achieves cost reduction while being free from electromagnetic interferences.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF PREFERRED EMBODIMENTS

An embodiment of the present invention will be explained below with reference to the accompanying drawings.

Figure 1:
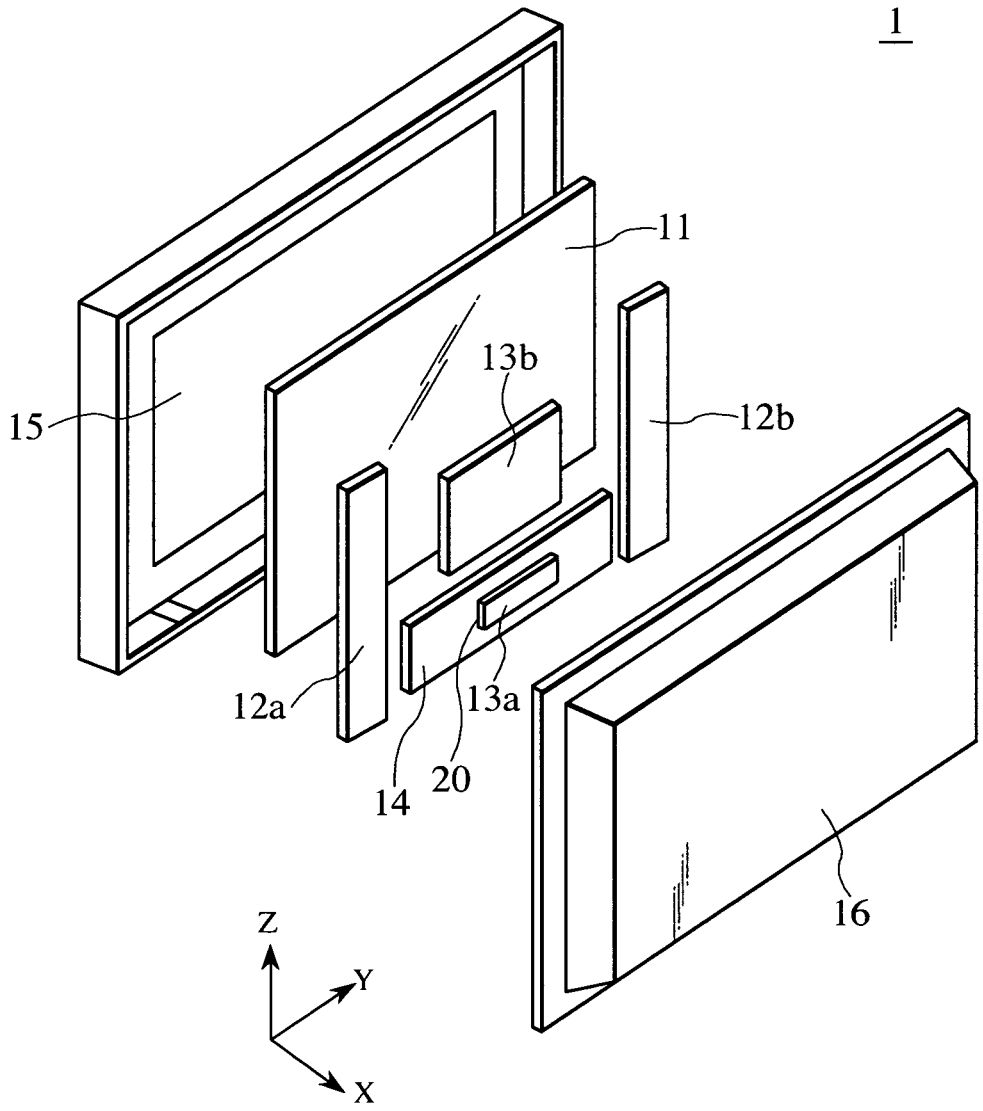
FIG. 1 is a diagram showing a configuration of a display apparatus with a plasma display panel according to the embodiment of the present invention.
Figure 2:
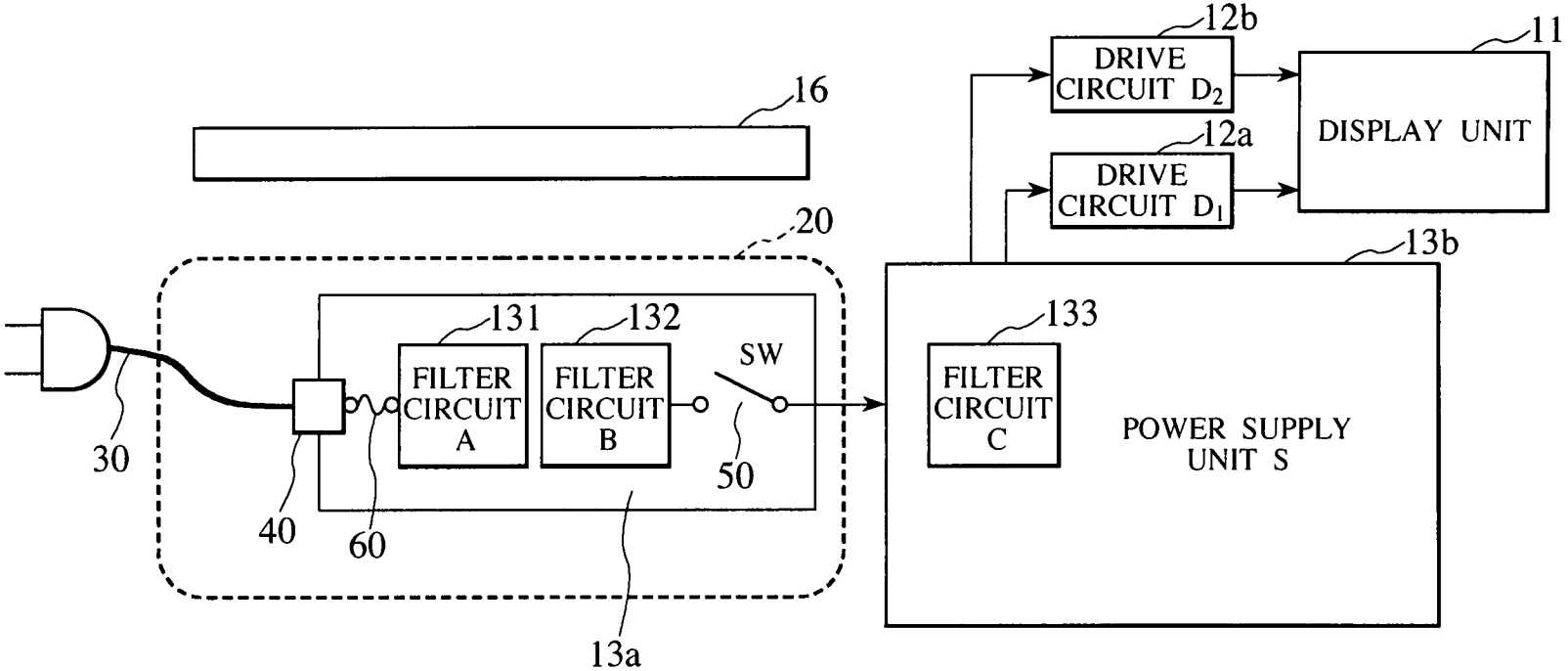
FIG. 2 is a schematic diagram showing a circuit configuration in the display apparatus with the plasma display panel shown in FIG. 1.
Figure 3:
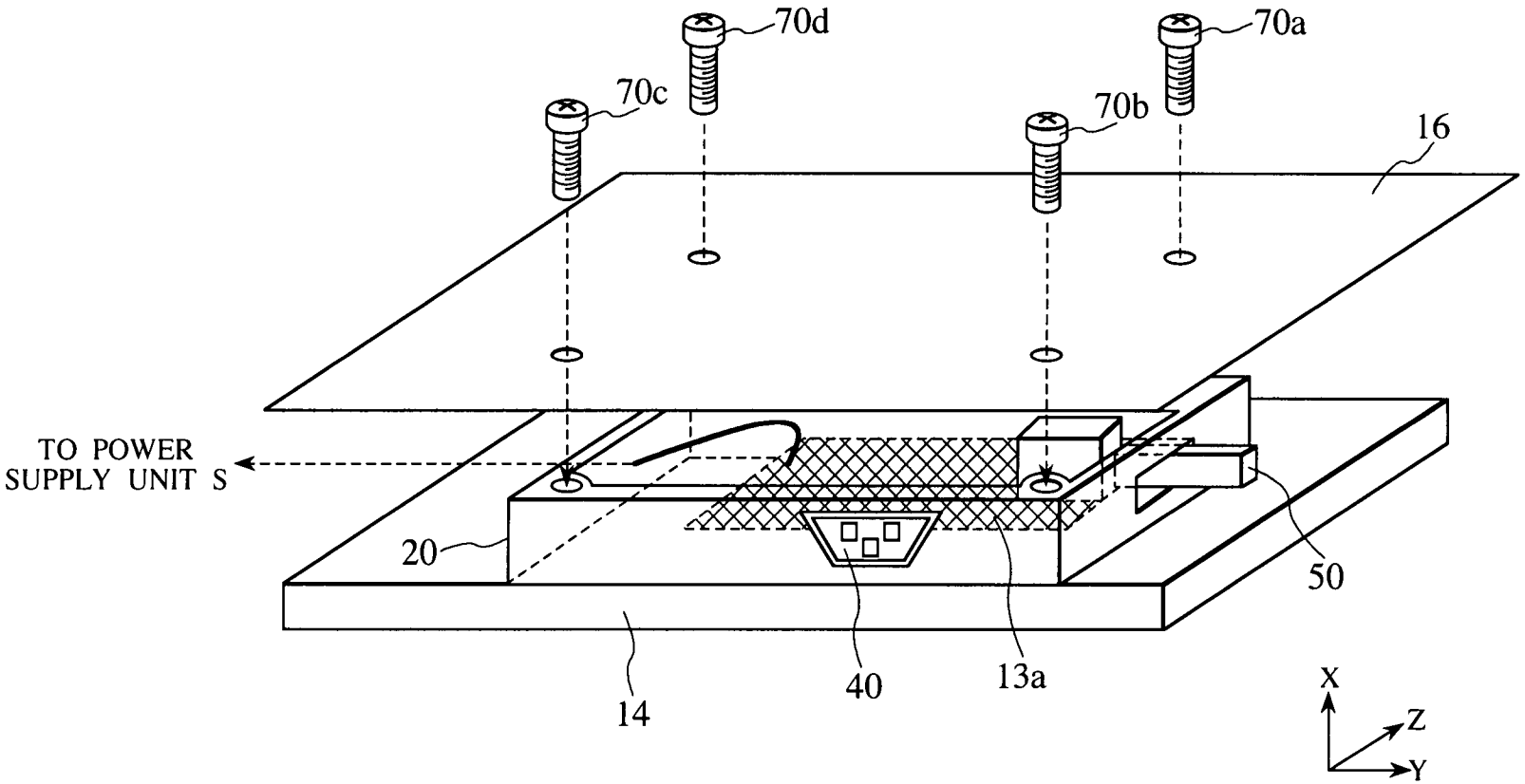
FIG. 3 is a perspective diagram of the appearance of a power supply circuit and electromagnetic shielding means in the display apparatus with the plasma display panel shown in FIG. 1.
Figure 4:
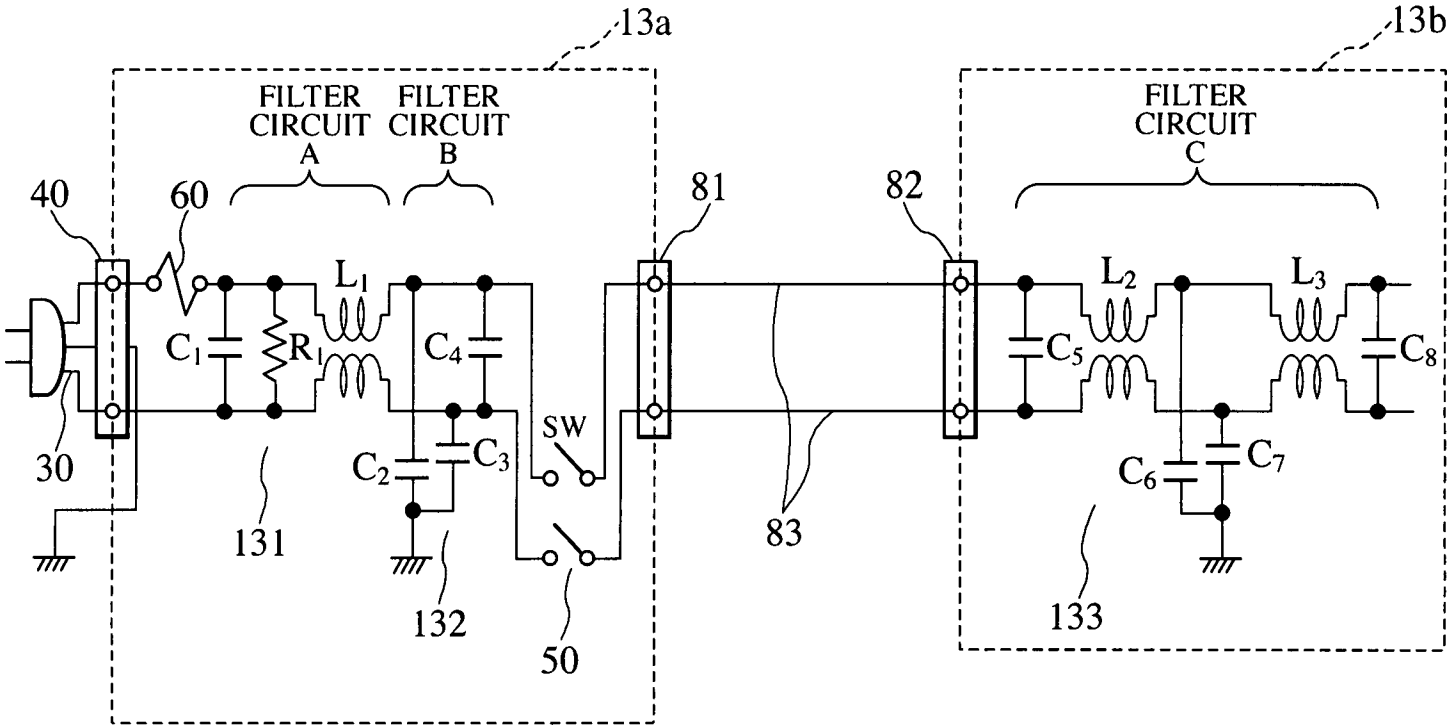
FIG. 4 is a diagram showing an example of the configuration of the power supply circuit and a power supply unit in the display apparatus with the plasma display panel shown in FIG. 1.
Figure 5:
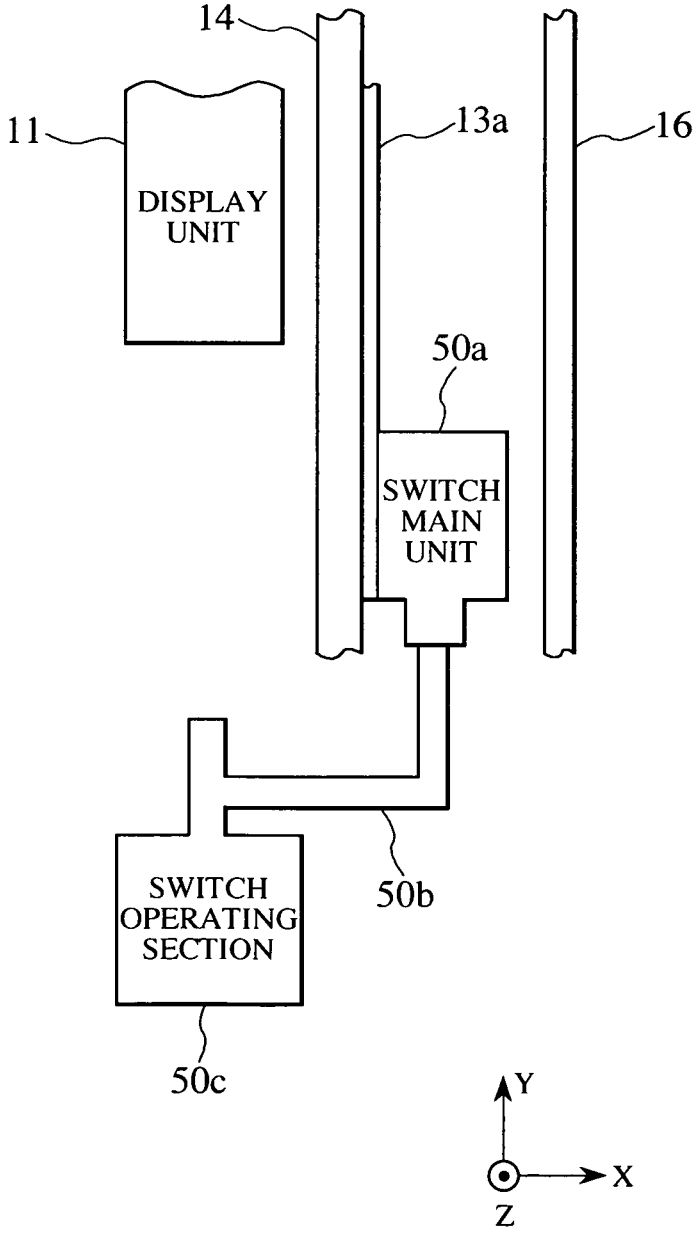
FIG. 5 is a diagram showing an example of the configuration of a switch used in the power supply circuit shown in FIG. 4.
Figure 6:
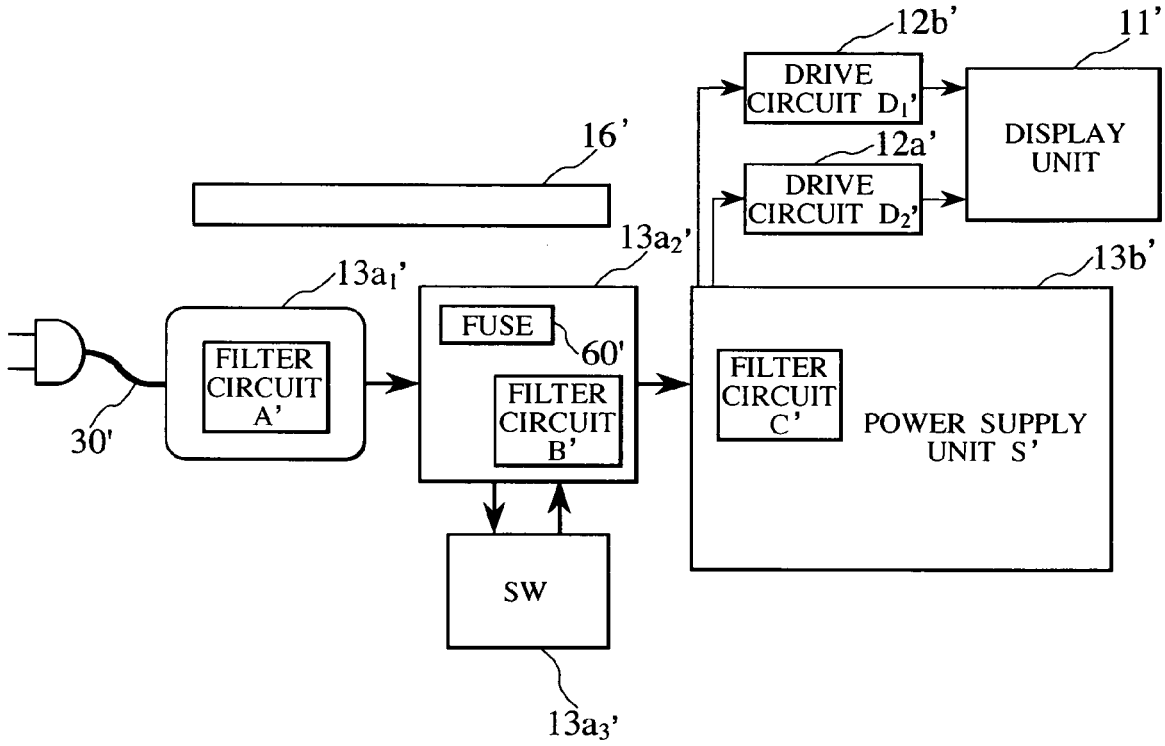
FIG. 6 is a schematic diagram of a circuit configuration of a conventional display apparatus with a plasma display panel.
Figure 7:
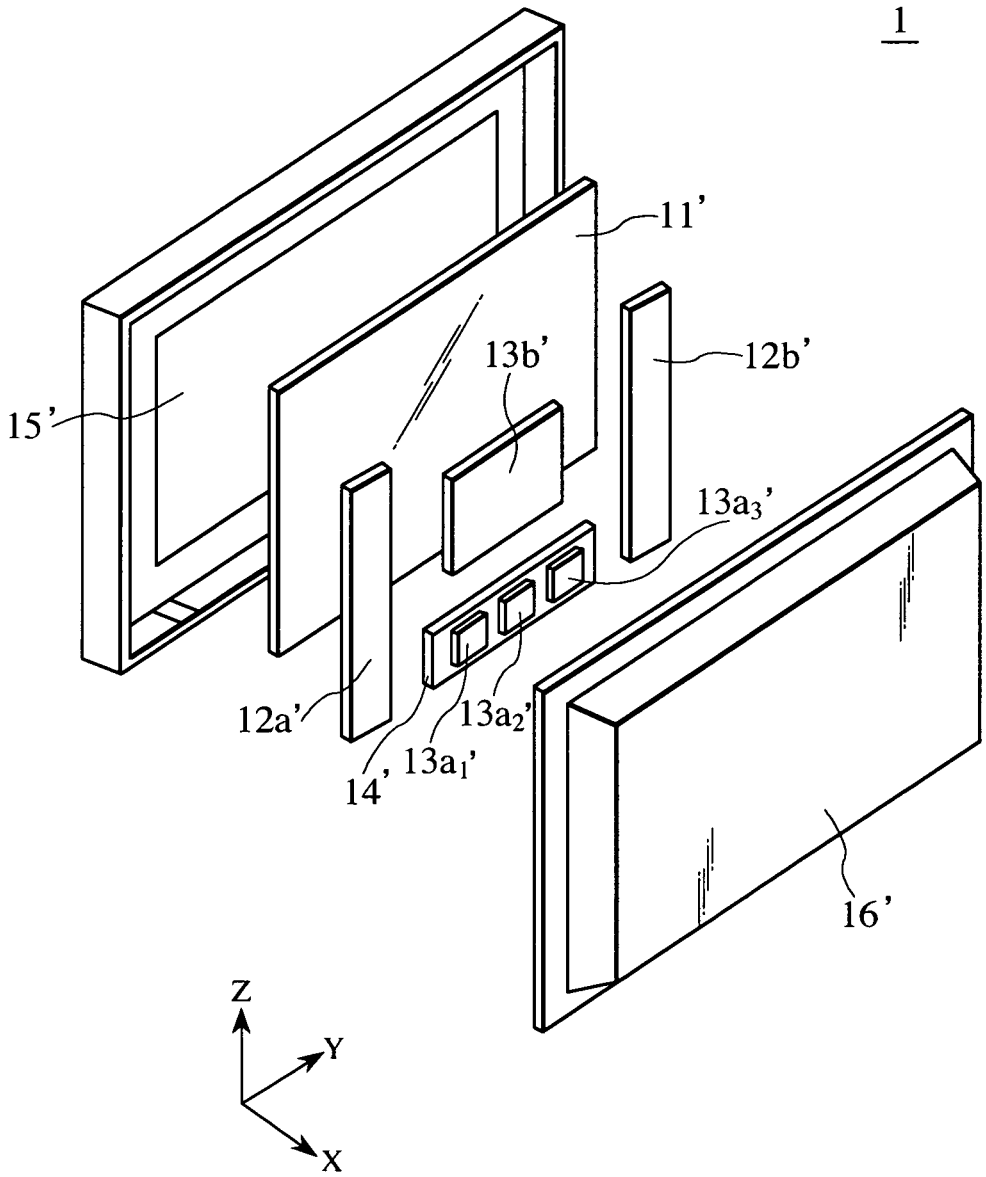
FIG. 7 is a diagram showing an example of the configuration of a conventional display apparatus with a plasma display panel.

FIGS. 1 through 5 are diagrams explaining the embodiment of the present invention. FIG. 1 is a diagram showing an example of the configuration of a display apparatus with a plasma display panel according to the embodiment of the present invention. FIG. 2 is a schematic diagram of a circuit configuration in the apparatus shown in FIG. 1. FIG. 3 is a perspective diagram of an appearance of a power supply circuit and electromagnetic shielding means of circuits in the apparatus shown in FIG. 1. FIG. 4 is a diagram showing an example of the configuration of the power supply circuit and a power supply unit of circuits in the apparatus shown in FIG. 1. FIG. 5 is a diagram showing an example of the configuration of a switch used in the power supply circuit shown in FIG. 4.

In FIG. 1, reference numeral 1 denotes a display apparatus with a plasma display panel according to the embodiment of the present invention; 11, a plasma display panel used as a display unit which display an image by means of electric discharge between electrodes arranged in a matrix form; 12*a* and 12*b*, circuit boards each having a drive circuit formed thereon which drives the electrodes of the plasma display panel 11 based on an image signal; 13*a*, a circuit board with a power supply circuit (not shown) mounted thereon which supplies an AC input from an external AC power supply, eliminates noise components, and outputs a current; 13*b*, a circuit board with a power supply unit (not shown) formed thereon which allows conversion of AC power into DC power; 14, a retaining fitting to which the circuit board 13*a* is secured; 20, a shielding frame member made of metal material, used as a first shielding section of the electromagnetic shielding means which surrounds the lateral side of the circuit board 13*a*; 16, a rear cover made of metal material, arranged at the rear (X-axis direction side) of the plasma display panel 11, which covers the plasma display panel 11, circuit boards 12*a*, 12*b*, 13*a*, and 13*b*; and 15, a front filter arranged at the front (−X-axis direction side) of the plasma display panel 11.

On the circuit board 13*a* installed are an AC inlet (not shown) to which a lead wire (power cord) is connected from an external AC power supply, a filter circuit (not shown) with an inductance element connected thereto which attenuates electromagnetic waves, a switch (not shown) which switches on/off an AC output from the filter circuit, and a fuse (not shown) which protects the circuit from overcurrent. Further, the rear cover 16 is combined with the shielding frame member 20 in such a manner that a part of the flat section thereof shuts an opening on the Z-axis direction side of the shielding frame member 20, wherein a part of the flat section of the rear cover 16 forms a second shielding section of the electromagnetic shielding means which covers the upper side of the circuit board 13*a* of the power supply circuit. The drive circuits (not shown) mounted on the circuit boards 12*a* and 12*b* operate with power supplied from a power supply unit mounted on the circuit board 13*b*. The AC power is supplied to the power supply unit from a power supply circuit mounted on the circuit board 13*a* through a switch in the power supply circuit.

In the following explanations, same numerals are assigned to the same components as those in FIG. 1. Further, in the following drawings, the same coordinate axes as those in FIG. 1 are used.

FIG. 2 is a schematic diagram of a circuit configuration in the display apparatus 1 with a plasma display panel shown in FIG. 1.

In FIG. 2, reference numeral 131 denotes a filter circuit A formed on the circuit board 13*a* of the power supply circuit, which includes an inductance element to particularly attenuate high-frequency components of electromagnetic waves generated in the plasma display panel 11; 132, a filter circuit B connected to the filter circuit A131, which includes capacitors to particularly attenuate low-frequency components of electromagnetic waves generated in the plasma display panel 11; 133, a filter circuit C formed on the circuit board 13*b* of the power supply unit S, which includes inductance elements to particularly attenuate high-frequency components of electromagnetic waves generated in the plasma display panel 11; 12*a*, a circuit board with a drive circuit D1 formed thereon which drives electrodes of the plasma display panel 11 based on an image signal; 12*b*, a circuit board with a drive circuit D2 similarly formed thereon; 30, a power cord; 40, an AC inlet to which the power cord 30 is connected; 50, a switch which switches on/off an AC output from the filter circuit B; 60, a fuse which protects the filter circuit A131 and filter circuit B132 from overcurrent. Other reference numerals are the same as those in FIG. 1. The filter circuit B is connected to the filter circuit C 133 of the power supply unit S through the switch 50. For the circuit board 13*a* of the power supply circuit, the lateral side is surrounded by the shielding frame member 20 used as a first shielding section of the electromagnetic shielding means and the upper side is covered by a part of the flat section of the rear cover 16 used as a second shielding section of the electromagnetic shielding means.

With the above-mentioned configuration, the AC input is supplied from the power cord 30 into the circuit board 13*a* through the AC inlet 40 and then inputted to the filter circuit A131 through the fuse 60; the filter circuit A131 attenuates high-frequency components of electromagnetic waves generated in the plasma display panel 11 and entered to the power supply unit; and the filter circuit B132 attenuates low-frequency components of electromagnetic waves generated in the plasma display panel 11.

The AC output from the filter circuit B132 is inputted to the filter circuit C on the circuit board 13*b* of the power supply unit S through the switch 50. The filter circuit C also attenuates high-frequency components of electromagnetic waves. Electromagnetic waves generated in the plasma display panel 11 are transmitted from the power supply unit S to the power supply circuit, i.e., from the filter circuit C 133 to the filter circuit B132 and then to the filter circuit A131. Accordingly, electromagnetic waves that are not sufficiently attenuated by the filter circuit C 133 are attenuated by the filter circuit B132 and then by the filter circuit A131. The output of the power supply unit S is inputted to the drive circuit D1 mounted on the circuit board 12*a* and the drive circuit D2 mounted on the circuit board 12*b*. The drive circuits D1 and D2 form drive signals based on the image signal, and the plasma display panel (display unit) 11 is driven by the drive signals to display an image.

In the following explanations, same numerals are assigned to the same components as those in FIG. 2.

FIG. 3 is a perspective diagram showing an appearance of the electric wave circuit and electromagnetic shielding means in the display apparatus 1 with a plasma display panel shown in FIG. 1.

In FIG. 3, reference numerals 70*a* to 70*d* denote screws for combining the rear cover 16 with the upper side (X-axis direction side) of the shielding frame member 20. Other reference numerals are the same as those in FIG. 1 and FIG. 2. The circuit board 13*a* with the AC inlet 40, the fuse 60, the filter circuit A131, the filter circuit B132, and the switch 50 installed thereon is secured on the surface of a retaining fitting 14. The lateral side of the circuit board 13*a* is surrounded by the shielding frame member 20. The shielding frame member 20 is also secured on the surface of the retaining fitting 14. By electrically coupling the rear cover 16 with the upper side (X-axis direction side) of the shielding frame member 20, the circuit board 13*a* is covered by the shielding frame member 20 and the rear cover 16 to shield electromagnetic waves radiated from the plasma display panel. The AC inlet 40 is provided with pins and holes for connection.

FIG. 4 is a diagram showing an example of the configuration of the power supply circuit and the power supply unit of circuits in the apparatus shown in FIG. 1.

In FIG. 4, reference numerals C1, R1, and L1 denote a capacitor, a resistor, and an inductance element, respectively, which form the filter circuit A131; C2, C3, and C4, capacitors that form the filter circuit B132; C5 to C8 and L2 to L3, capacitors and inductance elements, respectively, which form the filter circuit C 133 of the power supply unit S. The circuit boards 13*a* and 13*b* are connected by lead wires 83 and connectors 81 and 82.

FIG. 5 is a diagram showing an example of the configuration of the switch 50 used in the power supply circuit shown in FIG. 4.

In FIG. 5, reference numeral 50*a* denotes a main unit (hereafter referred to as a switch main unit) of the switch 50; 50*b*, an arm (hereafter referred to as a switch arm) of the switch 50; 50*c*, an operating section (hereafter referred to as a switch operating section) at which an external force for operation is applied to the switch 50. The switch operating section 50*c* is arranged substantially at the lateral side or the display unit side of the plasma display panel (display unit) 11 from the view point that the user performs an operation thereof. With this arrangement, the switch operating section 50*c* and the switch main unit 50*a*, which is installed on the circuit board 13*a* at a position separated from the position of the plasma display panel (display unit) 11 in the X-axis direction, are connected by the switch arm 50*b*. For example, when an external force added in the ±Z axis direction is applied to the switch operating section 50*c*, the external force acts on the switch main unit 50*a* through the switch arm 50*b* to switch on/off a contact in the switch main unit 50*a*. When the contact is switched on/off, the connection between the filter circuit B mounted on the circuit board 13*a* and the filter circuit C mounted on the circuit board 13*b* is turned on/off.

According to the above-mentioned embodiment of the present invention, the power supply circuit includes the AC inlet 40, the fuse 60, the filter circuit A131, the filter circuit B132, and the switch 50 and is mounted on a single circuit board 13*a*, which reduces the manufacturing cost of circuit boards and the assembly cost of the power supply circuit. In addition, the circuit board 13*a*, which forms the power supply circuit on the power cord side, is covered by the shielding frame member 20 and the rear cover 16, making it possible to effectively shield electromagnetic waves that leak from the power supply unit to the outside.

While we have shown and described several embodiments in accordance with our invention, it should be understood that disclosed embodiments are susceptible to changes and modifications without departing from the scope of the invention. Therefore, we do not intend to be bound by the details shown and described herein but intend to cover all such changes and modifications as fall within the ambit of the appended claims.

What is claimed is:

1. A power supply circuit for an image display apparatus having a plasma display panel, adapted to suppress leakage of electromagnetic waves generated in the plasma display panel to the outside of the image display apparatus, the power supply circuit comprising:

an AC inlet to which a power cord is connected to take in AC power supplied from an external AC power supply;

a filter circuit which includes an inductance element and is adapted to attenuate electromagnetic waves and supplied with the AC power through the AC inlet;

a mechanical switch which is connected to the filter circuit and includes a moving element that moves according to a user's operation and switches on/off the AC power supplied from the filter circuit; and a single circuit board on which the filter circuit is formed and the AC inlet and the mechanical switch are mounted;

wherein:

when the mechanical switch switches on the AC power, the AC power is supplied to a power supply unit that is connected to the power supply circuit through the mechanical switch and the plasma display panel is driven, and the electromagnetic waves generated in the plasma display panel are transmitted to the filter circuit through the power supply unit and attenuated in the filter circuit; and the power supply circuit is independently covered or surrounded by a shielding member and shielded from leaking the electromagnetic waves to the outside of the power supply circuit when the plasma display panel is driven.

2. The power supply circuit as defined in claim 1, wherein the filter circuit comprises:

a first filter circuit which has the inductance element and attenuates high-frequency components of the electromagnetic waves; and a second filter circuit which has capacitors and attenuates low-frequency components of the electromagnetic waves.

3. An image display apparatus for displaying an image, the apparatus comprising:

a power supply circuit which is adapted to suppress leakage of electromagnetic waves generated in the image display apparatus to the outside of the image display apparatus, and includes an AC inlet, a filter circuit, a mechanical switch and a single circuit board, the AC inlet to which a power cord being connected to take in AC power supplied from an external AC power supply, the filter circuit including an inductance element and being adapted to attenuate electromagnetic waves and supplied with the AC power through the AC inlet, the mechanical switch being connected to the filter circuit and including a moving element that moves according to a user's operation and switching on/off the AC power supplied from the filter circuit and the single circuit board on which the filter circuit being formed and the AC inlet and the mechanical switch being mounted;

a power supply unit which is connected to the power supply circuit and converts the AC power into DC power;

an electromagnetic shielding frame member which shields the power supply circuit from leaking the electromagnetic waves outside;

a plasma display panel which displays an image based on the image signal;

a drive circuit to which the DC power is supplied from the power supply unit to drive the plasma display panel based on an image signal; and a rear cover which is disposed at a back side of the plasma display panel and covers the power supply circuit, the power supply unit, the plasma display panel, the drive circuit and the electromagnetic shielding frame member;

wherein:

when the mechanical switch switches on the AC power, the AC power is supplied to a power supply unit through the mechanical switch and the plasma display panel is driven, and the electromagnetic waves generated in the plasma display panel are transmitted to the filter circuit through the power supply unit and attenuated in the filter circuit and in the power supply unit;

the electromagnetic shielding frame member has a frame-shaped configuration having an opening on its upper side and surrounds the power supply circuit independently; and the rear cover is combined with the electromagnetic shielding frame member in such a manner that a part of a flat section of the rear cover shuts the opening of the electromagnetic shielding frame member and shields the power supply circuit from leaking the electromagnetic waves to the outside of the image display apparatus together with the electromagnetic shielding frame member.

4. The image display apparatus as defined in claim 3, wherein the mechanical switch has an L-shaped arm for operation and is activated by a force transmitted by the arm.

5. The image display apparatus as defined in claim 3, wherein the filter circuit included in the power supply circuit comprises:

a first filter circuit to attenuate which has the inductance element and attenuates high-frequency components of the electromagnetic waves; and a second filter circuit which has capacitors and attenuates low-frequency components of the electromagnetic waves.

6. The image display apparatus as defined in claim 5, wherein the power supply unit includes a third filter circuit, the third filter circuit being connected to the mechanical switch and attenuating high-frequency components of electromagnetic waves.

7. An image display apparatus for displaying an image, the apparatus comprising:

a display panel which displays the image based on an image signal;

a drive circuit which is disposed on a back side of the display panel to drive the display panel;

a power supply circuit which is disposed on the back side of the display panel and supplies electric power to the drive circuit, the power supply circuit being arranged to suppress leakage of electromagnetic waves generated in the display panel and having an AC inlet, a filter circuit, a mechanical switch and a single circuit board, the AC inlet being adapted to take in AC power supplied from an external AC power supply via through a power cord, the filter circuit being adapted to attenuate the electromagnetic waves generated in the display panel and supplied with the AC power through the AC inlet, the mechanical switch being connected to the filter circuit and including a moving element which moves according to a user's operation and switching on/off the AC supplied from the filter circuit and the single circuit board on which the filter circuit being formed and the AC inlet and the mechanical switch being mounted;

an electromagnetic shielding frame member which shields the power supply circuit from leaking the electromagnetic waves outside; and a rear cover which is disposed at the back side of the display panel and covers the display panel, the drive circuit, the power supply circuit and the electromagnetic shielding frame member;

wherein:

when the mechanical switch switches on the AC power, the display panel is driven by the drive circuit, and the electromagnetic waves generated in the display panel are transmitted to the filter circuit and attenuated in the filter circuit;

the electromagnetic shielding frame member has a frame-shaped configuration having an opening on its upper side and surrounds the power supply circuit independently; and the rear cover is combined with the electromagnetic shielding frame member in such a manner that a part of a flat section of the rear cover shuts the opening of the electromagnetic shielding frame member and shields the power supply circuit from leaking the electromagnetic waves to the outside of the image display apparatus together with the electromagnetic shielding frame member.

8. The image display apparatus as defined in claim 7, wherein the mechanical switch has an L-shaped arm for operation and is activated by a force transmitted by the arm.

* * * * *